United States Patent [19]

Westmoreland

[11] Patent Number: 4,481,689

[45] Date of Patent: Nov. 13, 1984

[54] SCRAPING TOOL

[76] Inventor: Burton Westmoreland, 319 Huffhines, Richardson, Tex. 75081

[21] Appl. No.: 399,298

[22] Filed: Jul. 19, 1982

[51] Int. Cl.[3] ..... A47L 13/08

[52] U.S. Cl. ..... 15/236 R; 30/169

[58] Field of Search ..... 15/236 R, 172, 245; 30/169, 172, 87, 89

[56] References Cited

U.S. PATENT DOCUMENTS

| | | | |
|---|---|---|---|
| 4,094,063 | 6/1978 | Trotta | 30/89 |
| 4,156,966 | 6/1979 | Eubank | 30/172 |
| 4,347,663 | 9/1982 | Ullmo | 30/89 |
| 4,381,604 | 5/1983 | Horst | 15/236 X |

FOREIGN PATENT DOCUMENTS

| | | | |
|---|---|---|---|
| 269401 | 4/1927 | United Kingdom | 15/236 R |

*Primary Examiner*—Edward L. Roberts

*Attorney, Agent, or Firm*—Hubbard, Thurman, Turner & Tucker

[57] ABSTRACT

An improved scraping tool has a pivoting scraping blade. The top of the blade holder has an axis parallel to the blade edge and it is pivotally attached under a support arm which is an angled extension of a grasping handle. The blade holder swivels freely within predetermined limits on the angled handle extension to obtain an optimum working angle. The pivoting blade permits the handle to be angled away from the working surface.

5 Claims, 3 Drawing Figures

SCRAPING TOOL

BACKGROUND AND SUMMARY OF THE INVENTION

The present invention relates generally to hand tools and more specifically to an improved tool for scraping surfaces.

A variety of hand-held scraping tools have been devised for removing a layer of undesired material from a solid, usually planar, surface. Scrapers are typically used, for example, to remove old paint from the wood or other surface to which it has been applied, or to remove paint spatters on glass.

Most presently used scrapers have a similar design. They consist of an elongate handle having a scraping edge attached to one end. The line of the scraping edge lies generally perpendicular to the lengthwise axis of the handle. These scrapers are used by sliding the scraping edge along a surface in the direction of the handle length, and may be pulled toward, or pushed away from, the user.

Such present day scrapers have several important drawbacks. In many cases, the application of high pressure to the scraping tool often causes portions of the user's hand to come into painful contact with the surface being scraped, or other nearby surfaces. Additionally, the blade of presently used scrapers is generally fixed with relation to the handle, thus making maneuverability near irregular edges and corners poor.

Another important drawback of present scraping devices is the awkward manner in which they must be held when used. Force is applied in either direction along the forearm of the user, which is aligned with the long axis of the handle. In order to grip the handle, the wrist must be bent at an awkward angle. This causes the user's wrist to tire fairly quickly when large forces are being applied to the scraper, and limits the maximum force which may be applied due to the awkwardness of the grip.

It would be desirable for a scraping device to be held by the user in such a manner that the application of pressure to the scraping edge would not be needlessly tiring or awkward. It would be further desirable that the scraping tool is fashioned in such a manner that the hand gripping the tool has minimum susceptibility to injury due to contact with various surfaces. It would also be desirable that such a scraping tool is easily used to scrape around corners, and around irregular surfaces and edges. Additionally, such a tool should be simple and inexpensive to manufacture.

It is an object of the present invention to overcome the above-named and other disadvantages of present day scrapers, and to provide a tool which is comfortable and relatively non-tiring to use, which helps prevent injury to the user's hand, which maneuvers easily around irregular areas and which is inexpensive to manufacture.

In order to accomplish these and other objects, a scraping tool constructed according to the present invention includes a scraping edge which is aligned parallel to a bent handle extension (support arm) that itself is parallel to the surface to be scraped when the scraping edge is resting on the surface in a right angle relationship to the surface. The handle is angled away from the scraping edge so that when the scraping edge is in full contact with a planar surface, the handle angles away from the surface. In use, the scraping edge is pivotable, within predetermined limitations, about an axis perpendicular to the scraped surface. This pivoting movement is made relative to the handle in order to increase the maneuverability of the scraper. In a preferred embodiment, means are provided for securely coupling a detachable scraping blade to the tool to help prevent injury to the user.

The novel features which characterize the present invention are defined by the appended claims. The foregoing and other objects and advantages of the invention will hereinafter appear, and for purposes of illustration, but not of limitation, a preferred embodiment is shown in the accompanying drawings.

DESCRIPTION OF THE PREFERRED EMBODIMENT

Figure 1:
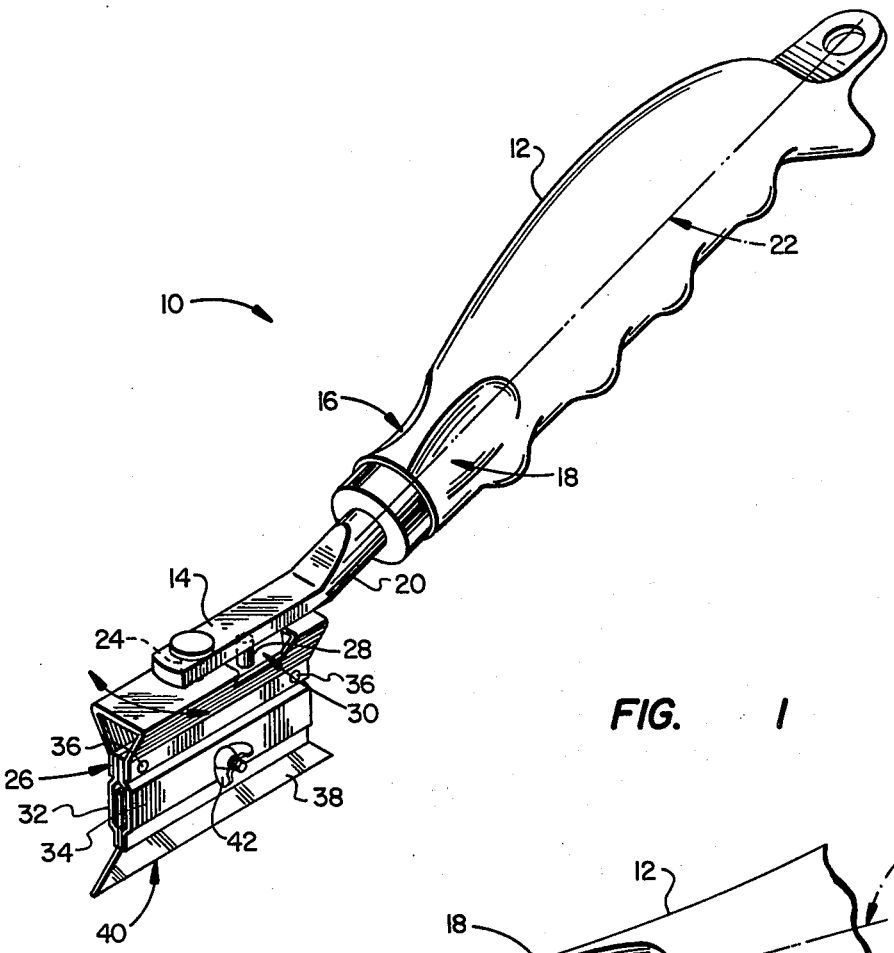
FIG. 1 is a perspective view of a new and improved scraping tool according to the present invention.

As shown in the drawings, a preferred embodiment of a scraper 10 according to the present invention has a handle 12 coupled to a support arm 14. The handle 12 is preferably shaped to be comfortably gripped by the hand, and preferably includes thumb grooves 16, 18 located near the end coupled to the support arm 14. Two thumb grooves 16, 18 are located on opposite sides of the handle 12 so that the scraper 10 may be used with the left or the right hand.

Figure 2:
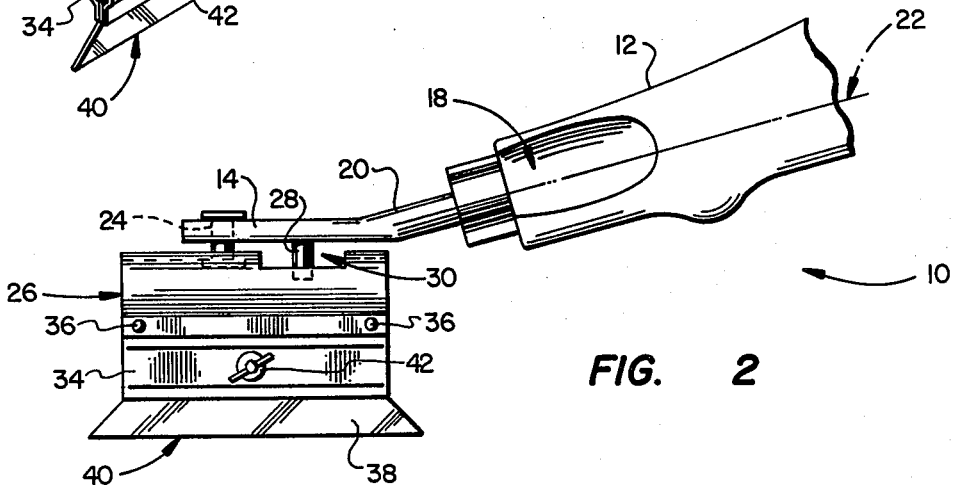
FIG. 2 is a side view of a portion of a tool according to the present invention.

The support arm 14 is coupled to the handle 10 by a connecting rod 20. The connecting rod 20 is generally cylindrical and made of steel or like material. The connecting rod 20 is coupled to the handle 12 in a manner well known in the hand tool art, and extends along the lengthwise axis 22 of the handle 12. As is shown best in FIG. 2, the support arm 14 is coupled to the connecting rod 20 at an angle. In the preferred embodiment, the angle between the support arm 14 and the handle axis 22 is approximately 20° to 30°. An advantage of using a scraper 10 having this angle is that the knuckles of the user are removed from close proximity to the surface being scraped, thereby preventing injured hands and allowing more pressure to be applied.

Figure 3:
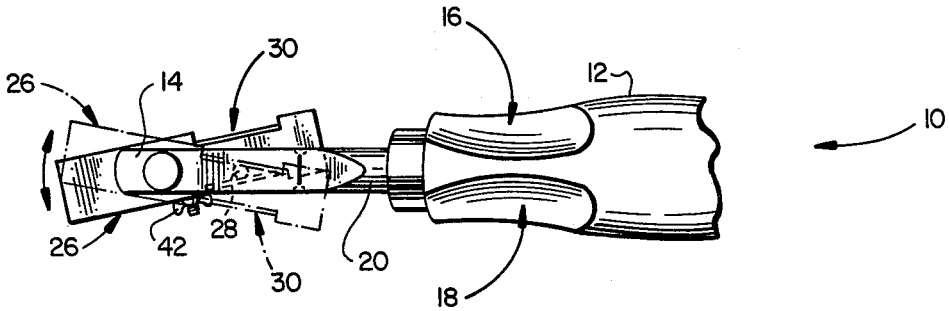
FIG. 3 is a top view of a portion of a tool according to the present invention.

A dowel 24 is coupled to, and projects from the underside of, the support arm 14, and acts as an axle for a holding member 26. In the preferred embodiment, the dowel 24 is fixedly coupled to the support arm 14 and the holding member 26 rotates about the dowel 24. Alternatively, the dowel 24 could be fixedly coupled to the holding member 26, and rotatably coupled to the support arm 14. A stopping pin 28 also projects from the underside of the support arm 14 into a groove 30 in the holding member 26. The holding member 26 is free to rotate until an edge of the groove 30 engages the stopping pin 28. The geometry of the groove 30 may be any which is suitable for its intended use. For example the groove 30 may be arcuate and would have a radius centered on the dowel 24 axis or rectangular for ease of manufacture. The embodiment shown in the drawings utilizes a rectangular groove 30 for manufacturing simplicity. In the preferred embodiment, the groove 30 is wide enough to allow the holding member 26 to pivot through approximately a 25° to 50° arc, as is best shown in FIG. 3. An alternative embodiment (not shown) has a slot in the support arm 14 and a pin coupled to the holding member 26.

The lower portion of the holding member 26 comprises two grasping plates 32, 34. The grasping plates 32,34 are coupled to each other along the upper edge, and to the upper portion of the holding member 26, by two rivets 36. The grasping plates 34, 36 are formed so that the lower edges press together under spring tension when the holding member 26 is assembled, whereby a scraping blade 38 can be inserted between the grasping plates 32, 34 and held in place.

The scraping blade 38 can be any conventional device having a suitable scraping edge 40, such as a single edged razor blade. In the preferred embodiment shown in the drawings, the scraping blade 38 has a flared lower portion, giving a scraping edge 40 wider than the length of the holding member 26. It will be apparent to those skilled in the art that the length of the holding member 26 can be selected to match the scraping blade 38 to be used.

The scraping blade 38 is held in place by the spring tension of the grasping plates 32, 34, and can be used as described, without further means for fixing the scraping blade 38 in place. However, in the preferred embodiment, means are provided for fixing the blade 38 more firmly in place to prevent slippage and possible injury to the user or damage to the blade 38. A bolt 42 may be threadably engaged with grasping plate 34 to press against the scraping blade 38 when tightened. Tightening the bolt holds the blade 38 in place with a firm friction fit, preventing slippage. As an alternative, the blade 38 can be provided with a hole (not shown) which matches the position of the bolt 42. The bolt 42 then projects through the scraping blade 38, thereby holding the blade in place.

As described above, it is preferred that a removable scraping blade 38 be used. This allows the blade 38 to be removed for safety during storage, which is important when very sharp blades 38 are used. Also, blades 38 can be replaced when worn or damaged. As will be apparent to those skilled in the art, a unitary holding member/blade piece (not shown) may be used instead, and such modification is contemplated as falling within the scope of the present invention. Also, the holding member 26 can be cast in a single piece, having a slot adapted for receiving the blade 38.

In use, the handle 12 is grasped firmly with one hand, with the thumb being placed in the appropriate thumb groove 16 or 18. As shown in FIG. 1, when the tool 10 is used with the right hand, the thumb will be placed in thumb groove 18. The axis 22 is approximately perpendicular to the forearm of the user. This is a comfortable, natural position for the hand and wrist, allowing maximum force to be transmitted through the wrist without undue strain or awkwardness. In addition to force transmitted along the forearm, additional force can applied to the scraping edge 40 by rotating the wrist. Much greater overall force can be applied to the scraping edge 40 with less strain than designs which require the hand and wrist to be turned to an awkward angle. In addition, the angle of the handle 12 brings the user's hand away from the surface being scraped. This prevents parts of the hand from rubbing against such surface, allowing greater force to be applied with less chance of injury.

Since the holding member 26 is free to swivel as described above, the handle 12 can be turned to the optimum angle in relation to the scraping edge. The swivel feature allows one to easily scrape a surface in corners and around irregular borders. As described above, the preferred embodiment of the present invention is simple and easy to construct, allowing scrapers 10 embodying the invention to be produced for low cost.

Although a preferred embodiment has been described in detail, it should be understood that various substitutions, alterations, and modifications may become apparent to those skilled in the art. These changes may be made without departing from the spirit and scope of the invention as defined by the appended claims.

What is claimed is:

1. A scraping tool comprising:

an elongate handle having an axially mounted connecting rod extending from one end;

a support arm coupled to said connecting rod at an angle, which forms an angled extension of said handle;

a pivotable holding member for holding a blade having a scraping edge;

a scraping blade mounted in the holding member having a scraping edge which is pivotable with said holding member to a position in which the scraping edge is aligned parallel to said support arm;

dowel means forming a pivotal connection between said support arm and said holding member about a pivot axis so that said scraping edge may be aligned with said support arm and may be swiveled about said pivotal connection to be angled with respect to said support arm; and means for limiting the pivotal movement of said holding member relative to said support arm.

2. The device of claim 1, wherein said pivotable movement limiting means comprises a stopping pin coupled to said support arm, which projects below said support arm into a groove under the pin in the upper portion of the holding member wherein said stopping pin projects below the edges of the groove and permits the holding member to pivot freely until one of the grooved edges comes into contact with the stopping pin.

3. The device of claim 2, wherein said holding member comprises:

an upper portion pivotally coupled below said support arm, by a dowel;

a lower portion comprising first and second grasping plates having upper and lower edges; and means for coupling the upper edges of said grasping plates to said upper portion, wherein the lower grasping plate edges make contact under tension, and further wherein a space is defined therebetween.

4. The device of claim 3, further comprising a bolt threadably engaged with said first grasping plate, wherein rotation of said bolt causes it to project into the space between said grasping plates.

5. The device of claim 4, wherein said handle has at least one thumb groove on the end nearest said support arm.

* * * * *